United States Patent [19]

Lezgintsev et al.

[11] 4,345,461

[45] Aug. 24, 1982

[54] APPARATUS FOR TAKING BEDROCK SAMPLES FROM BOTTOM OF DEEP-WATER BASINS

[76] Inventors: Georgy M. Lezgintsev, Leninsky Prospekt, 39, kv. 257; Evgeny I. Garbuz, ulitsa Pavla Andreeva, 28, Korpus 7, kv. 431; Evgeny A. Kontar, ulitsa Kropotkinskaya, 9, kv. 2, all of Moscow; Rudolf G. Glukhikh, ulitsa Pavilostas, 7, kv. 7, Latviiskaya SSR, Liepaya; Ivar O. Murdmaa, ulitsa Vavilova, 31, Korpus 1, kv. 96, Moscow; Vadim G. Soluyanov, ulitsa Artema, 59/65, kv. 133, Kiev; Alexandr S. Belyavsky, Altufievskoe Shosse, 24"b", kv. 135; Alexei N. Kuznetsov, Rublevskoe Shosse, 101, kv. 39, Korpus 2, both of Moscow, all of U.S.S.R.

[21] Appl. No.: 199,722

[22] PCT Filed: Nov. 30, 1979

[86] PCT No.: PCT/SU79/00126

§ 371 Date: Aug. 26, 1980

§ 102(e) Date: Jul. 10, 1980

[87] PCT Pub. No.: WO80/01413

PCT Pub. Date: Jul. 10, 1980

[30] Foreign Application Priority Data

| | | | |
|---|---|---|---|
| Dec. 26, 1978 | [SU] | U.S.S.R. | 2696400 |
| May 10, 1979 | [SU] | U.S.S.R. | 2766603 |
| May 29, 1979 | [SU] | U.S.S.R. | 2770102 |
| Jul. 23, 1979 | [SU] | U.S.S.R. | 2799894 |
| Sep. 24, 1979 | [SU] | U.S.S.R. | 2811901 |

[51] Int. Cl.[3] ..... G01D 21/00

[52] U.S. Cl. ..... 73/170 A; 73/864.52

[58] Field of Search ..... 73/170 A, 864, 864.52, 73/864.83

[56] References Cited

U.S. PATENT DOCUMENTS

| | | | |
|---|---|---|---|
| 3,078,931 | 2/1963 | Moore | 175/5 |
| 3,345,879 | 10/1967 | Nasu et al. | 73/170 A X |
| 3,593,533 | 7/1971 | Washington | 61/69 |
| 4,019,380 | 4/1977 | Raymond | 73/170 A |
| 4,116,069 | 9/1978 | Lezgintsev . | |

OTHER PUBLICATIONS

Oceanological Encyclopaedia pp. 292–293 and translation USSR.

*Primary Examiner*—Jerry W. Myracle

*Attorney, Agent, or Firm*—Lilling & Greenspan

[57] ABSTRACT

The apparatus for taking bedrock samples from the bottom of deep-water basins includes a self-contained device for obtaining spot samples of bedrock from the bottom of deep-water basins and more particularly to devices for taking bedrock samples from the bottom of deep-water basins.

The apparatus for taking bedrock samples from the bottom of deep-water basins is provided with a working member made in the form of a split housing having an open bottom and accommodating a shell to be destroyed by an initiating device at the moment the working member comes in contact with the bottom of a water basin, and a device for catching and holding a sample.

14 Claims, 12 Drawing Figures

APPARATUS FOR TAKING BEDROCK SAMPLES FROM BOTTOM OF DEEP-WATER BASINS

FIELD OF THE INVENTION

The present invention relates to self-contained technical means for taking spot samples of bedrock from the bottom of oceans or other deep-water basins and more specifically to an apparatus for taking bedrock samples from the bottom of deep-water basins.

The present invention is particularly useful for geological exploration, for hydrographic and oceanological researches.

DESCRIPTION OF THE PRIOR ART

At present known in the art are apparatuses for taking bedrock samples from the bottom of deep-water basins, such as dredges of various constructions. (Cf. Oceanological Encyclopaedia, 1974, pp. 292–293 /in Russian/).

Such an apparatus generally comprises a heavy tube or bucket provided with a net-like pocket to collect and keep chips of bedrock, and dragged over the bottom of a water basin being explored with the help of a cable secured on a ship.

They operate on the principle of taking or detaching rock fragments from a bedrock in the region of bedrock exposure on the bottom of deep-water basins.

However, raising of a bedrock sample from a water basin bottom is a very complicated operation. Usually an apparatus for taking bedrock samples is towed over the bottom in order to chip off a sample. Very often such attempts end in failure because of a broken cable or dredge and also because it is not always possible to detach a sample from the body of rock. Moreover, when employing such an apparatus, the exact fixing of the place of taking the sample is impossible since it is impossible to determine the location of the apparatus at the moment of taking the sample.

Also known in the art is a self-contained apparatus for taking sedimentary rock samples from the bottom of deep-water basins in the form of a free-falling sampler which is used to take sedimentary rock samples when carrying out industrial prospecting of deep-water deposits of ferromanganesia concretions of the ocean bed (cf. USSR Inventor's Certificate No. 566,162, Cl. G 01 N1/10, published in Journal of Discoveries, Inventions, Industrial Designs and Trademarks No. 27, 1977). This apparatus is essentially the closest prior art device for our invention.

This known apparatus comprises a frame with a float, containers with ballast weights, a working member in the form of a grab bucket, and a ballast dropping means.

The apparatus operates as follows:

On being dropped from a tender ship the apparatus due to negative buoyancy created by droppable ballast weights sinks.

When the apparatus comes in contact with the bottom of a water basin being explored, the ballast dropping means is actuated and the working member in the form of the grab bucket also operates and takes a sample. The ballast weights dropped, the apparatus for taking sedimentary rock samples attains positive buoyancy and emerges to the water basin surface.

Due to making a series of drops of such apparatuses, samples are periodically taken from the explored water basin bottom, thereby facilitating reconnaissance of deposits on the ocean bed.

However, such apparatuses can only be used for taking samples of soft and loose sedimentary deposits. They cannot be used for taking samples of compact bedrock.

SUMMARY OF THE INVENTION

The invention is essentially aimed at providing an apparatus for taking samples from the bottom of deep-water basins in which a working member and its structural elements would be made and interconnected so as to ensure taking a sample in a predetermined point, to accomplish separating, catching and bringing the sample to the surface and to guarantee the possibility of repeated use of the apparatus.

This is attained by an apparatus for taking bedrock samples from the bottom of deep-water basins incorporating a float with a rod and supporting frame, containers with ballast weights, a device for dropping ballast weights and a working member. In accordance with the present invention, the working member comprises a split casing having an open bottom and accommodating a shell destroyed by the action of an initiating device at the moment the working member comes in contact with the bottom of a water basin, and a device for catching and holding a sample.

Due to availability of the shell destroyed when acted upon by the initiating device at the moment of contact with the water basin bottom and a sharp decrease of pressure in the casing of the working member, it becomes possible to take samples exactly at a predetermined point of the water basin bottom, to separate, catch and bring a sample to the surface and to ensure the guaranteed repeated use of the apparatus.

Preferably the initiating device should be installed in the upper part of the working member and operatively associated with the device for dropping ballast weights, thereby providing guaranteed operation of the initiating device at the moment of reaching the water basin bottom.

It is also recommended that for increasing the operational reliability the initiating device be installed inside the shell and provided with an operatively independent release mechanism in the form of a spring-loaded inertia bush.

The initiating device may be made in the form of two sleeves arranged one inside the other, one of which is provided with an annular recess and the other is mounted on the lower part of the float rod for movement with respect to the first sleeve. The second sleeve may a striker having an annular recess and a spring disposed in the internal sleeve, retaining balls located in holes of the internal sleeve, a lock washer mounted under the sleeves.

Such interconnection of structural elements makes it possible to develop the energy of impact of the initiating device striker sufficient for destroying the shell.

It is expedient that the lower part of the working member casing should be provided with a packing ring to ensure isolation of an interior of the working member on rough or broken bedrock of the ocean bottom.

It is also expedient that the upper part of the working member casing should be split and have in its walls holes with check valves installed therein, thereby preventing the back outburst of the sample.

It is also recommended that the upper part of the split casing of the working member be made movable and the initiating device be mounted on the internal surface of the casing which ensures more reliable operation of the device and is substantially simple in construction.

It is desirable that the device for catching and holding a sample should be made in the form of a curtain shutter including flexible flaps, each being secured at one end to lower edges of the working member casing and at its other end to flexible links of the curtain shutter.

Such an embodiment of the device for catching and holding a sample provides for secure catching of a sample.

Besides, it is also possible to make the device for catching and holding a sample in the form of at least one row of pockets disposed axially with respect to the working member, which provides for reliable localization of a bedrock sample taken.

It is also desirable to provide the upper part of the working member casing with a thrower of a taper or hemispherical shape to optimally distribute the bedrock sample coming into the interior of the working member and to direct it into the pockets on the internal surface of the working member.

It is recommended to make the thrower rotatable about the axis of the initiating device, to install it with a clearance over the peripheral portion of the working member and to provide it with through holes and radial ribs.

Such an embodiment of the thrower makes it possible to use centrifugal forces occurring in the process of rotation of the thrower for more effective displacement of the sample to the peripheral portion of the working member where pockets are arranged.

It is preferable to make the thrower integral with a flywheel and operatively associated through an overrunning clutch with a hydraulic turbine mounted on the external part of the working member casing.

Such an interconnection of the structural elements makes it possible to use the energy of the flow incoming during submersion of the apparatus into the water by means of the hydraulic turbine and to transmit the torque thereof to the thrower.

It is preferable that the device for dropping ballast weights be disposed in the middle part of the supporting frame, coinciding with the float rod provided with pin-type catches cooperating with flexible links fixing the ballast weights, which enables a guaranteed drop of the ballast weights when the apparatus reaches the bottom of a water basin and a repeated use of the apparatus for taking samples as a whole.

It is also recommended that the upper part of the supporting frame should mount a guide sleeve with a movable bush having holes closed wth hydrostatic safety locks, which excludes premature dropping of the ballast weights and allows the apparatus for taking samples of bedrock from the bottom of deep-water basins to be used under conditions when waves on the water surface are considerable.

BRIEF DESCRIPTION OF THE DRAWINGS

Advantages of the invention will become more fully apparent from the following description of preferred embodiments thereof and the drawings in which.

Figure 5:
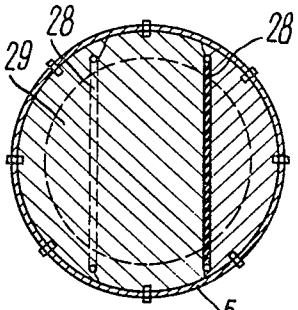
Figure 6:
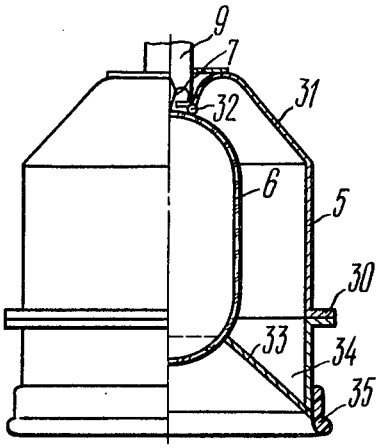
Figure 7:
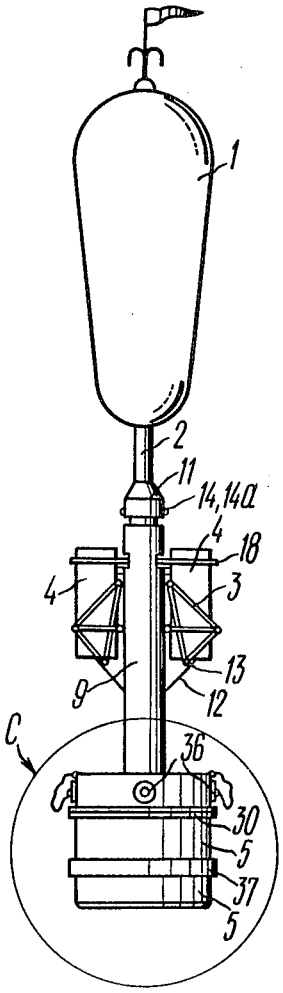
Figure 8:
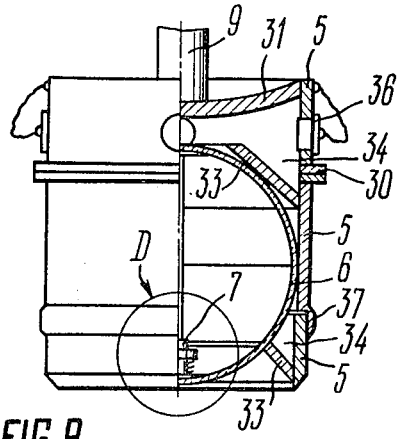
Figure 9:
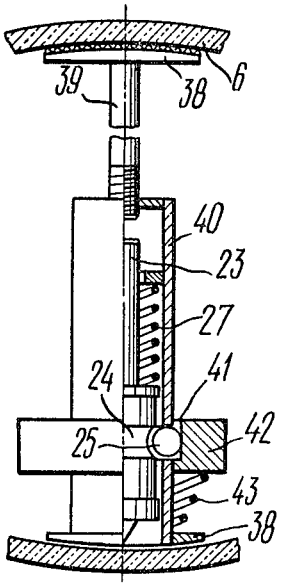
Figure 10:
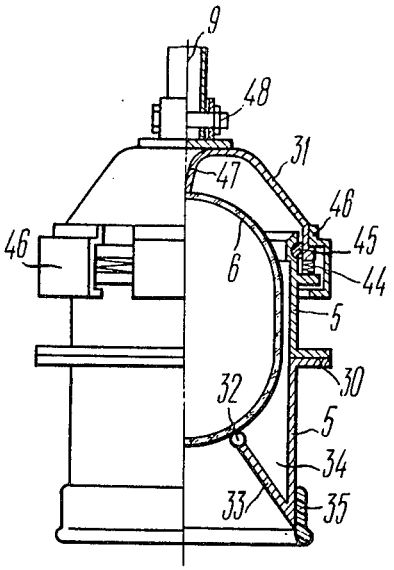
Figure 11:
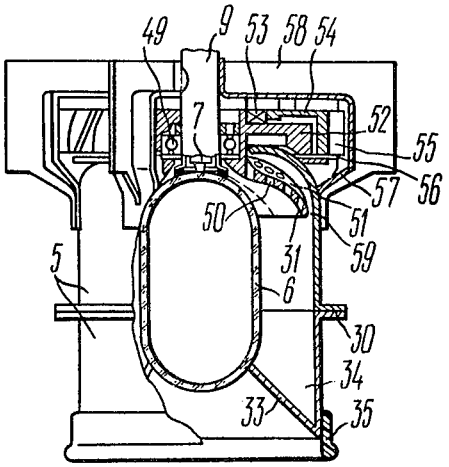
Figure 12:
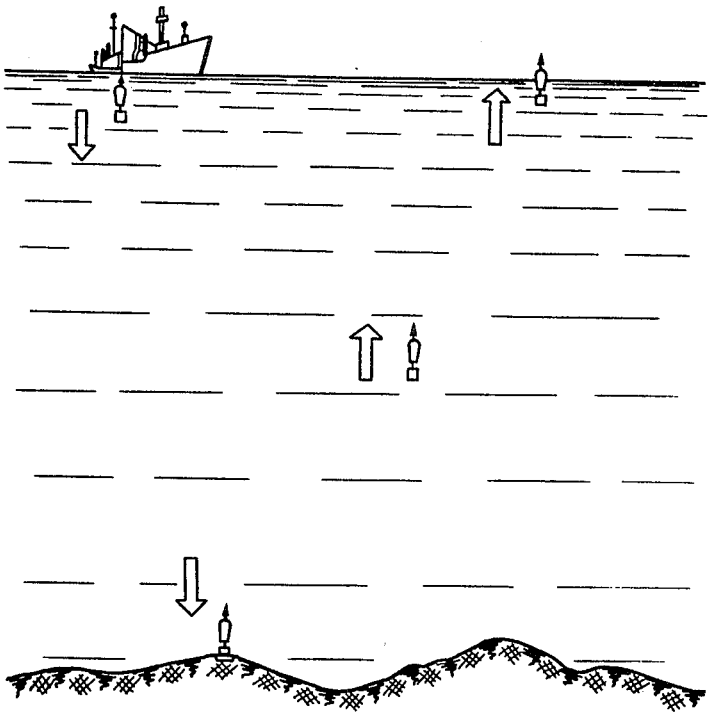

FIG . 4 is a bottom view of an apparatus (when submerged);

FIG. 5 is a bottom view of an apparatus (when emerging);

FIG. 6 is an enlarged, front view of a working member of an apparatus having a thrower and a pocket;

FIG. 7 is a front view of an apparatus having check valves;

FIG. 8 is an enlarged, front view of Detail C of FIG. 7;

FIG. 9 is an enlarged, front view, partly in section, of Detail D of FIG. 8;

FIG. 10 is a front view, partly in section, of an apparatus working member with an initiating device installed on its internal surface;

FIG. 11 is a front view, partly in section, of an apparatus working member having a rotatable thrower and a hydraulic turbine; and FIG. 12 shows general organization of work on taking samples of bedrock.

DETAILED DESCRIPTION OF THE INVENTION

According to the first embodiment of the present invention an apparatus comprises a float 1 with a rod 2 (FIG. 1), a container 3 with ballast weights 4, and a working member having a casing 5 with a shell 6 accommodated therein. Arranged in the upper part of the working member is an initiating device 7, and in its lower part is a curtain shutter 8. The apparatus also comprises a supporting frame 9 with a guide bush 10 disposed in the upper part thereof and a movable sleeve 11 mounted on the guide bush 10. Axles 13 of the containers 3 are mounted by means of knees 12 on the supporting frame 9. The movable sleeve 11 (FIG. 2) has diametrically opposite holes 14 disposed on its lateral surface and is provided with hydrostatic safety locks **14*a* positioned in the holes of the sleeve 11**. These locks are essentially sealed rubber reservoirs filled with air at a pressure of 1 to 3 atm. gauge.

The central rod 2 in its middle part is provided with pin-type catches 15; and the supporting frame 9 is provided with a barrel 16 disposed therein; and the barrel 16 accommodates on the diametrically opposite sides thereof shackles 17 cooperating with the pin-type catches 15.

The ballast weights 4 have fixing flexible links 18 secured on the shackles 17. The lower part of the rod 2 is connected with the initiating device 7.

The novelty of such an embodiment of the invention is in that the ballast dropping device is operatively associated with the initiating device 7.

Figure 3:
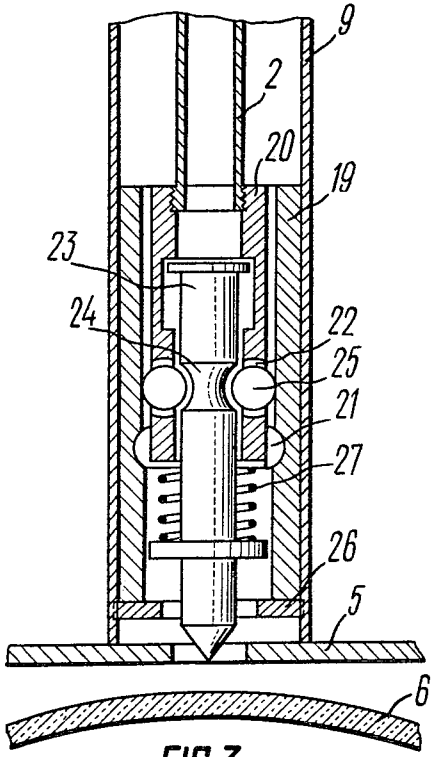
FIG. 3 is an enlarged, front cross sectional view of Detail B of FIG. 1.

The initiating device 7 (FIG. 3) comprises two sleeves disposed one inside the other, viz. an external sleeve 19 and an internal sleeve 20. The external sleeve 19 is arranged inside the lower part of the supporting frame 9 and provided with an internal annular recess 21. The internal sleeve 20 is fixed on the lower part of the rod 2, is movable vertically with respect to the external sleeve 19 and is provided with holes 22 disposed diametrically.

A striker 23 having an annular recess 24 is placed inside the internal sleeve 20. The holes 22 of the internal sleeve 20 accommodate retaining balls 25. A lock washer 26 is mounted under the sleeves 19 and 20. A spring 27 is positioned in the middle part of the striker 23.

The initiating device made like this is able to develop substantial enery of impact necessary for destroying the shell 6.

Figure 4:
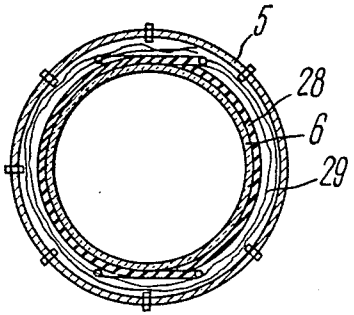

The curtain shutter 8 (FIG. 4 and 5) is provided with flexible links 28 and flexible flaps 29 which are secured at one side to the flexible links 28 and at the other side to the lower edge of the working member casing 5. The working member casing 5 has a flange connection 30.

The apparatus of the invention operates as follows.

Prior to being dropped from the ship, the apparatus is prepared for operation. For this, the ballast weights 4 are placed into the containers 3 and fastened over the perimeter with fixing links 18 and the shackles 17 are inserted into the barrel 16. Then, the initiating device 8 is armed. For this, the striker 23 is pressed upon to be displaced in the upper position in the sleeve 20 until the retaining balls 25 get into the annular recess 24. Further upward movement of the sleeve 20 in the sleeve 19 results in fixing the striker 23 in the operating position. While doing so, the rod 2 is moved upward, the pin-type catches 15 moving in the sleeve 19 catch the shackles 17 and the holes of the movable sleeve 11 and of the guide bush 10 align. The hydrostatic safety locks 14*a* are inserted into the holes 14 being conincident. This done, the shell 6 is placed into the casing 5 of the working member and the curtain shutter 8 is armed, which results in fixing the flexible links 28 with the surface of the shell 6.

The apparatus thus prepared for operation is dropped from the ship (FIG. 12).

Figure 1:
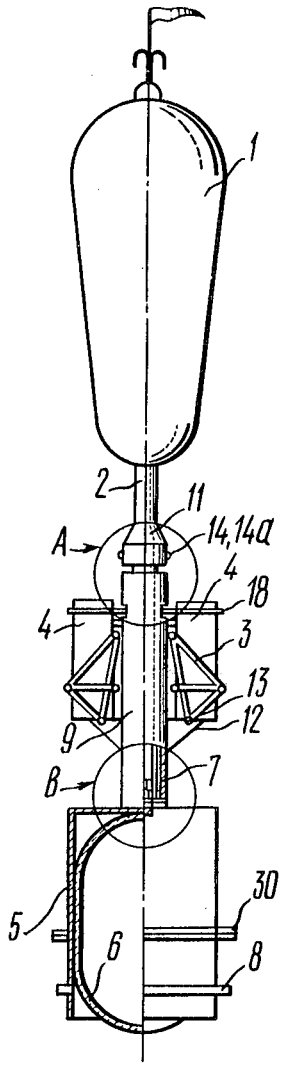
FIG. 1 is a front view of an apparatus for taking bedrock samples from the bottom of deep-water basins and provided with a curtain shutter (when submerging) in accordance with the invention.
Figure 2:
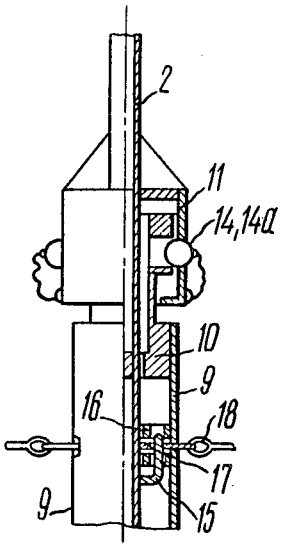
FIG. 2 is an enlarged, front view of Detail A of FIG. 1.

Under gravity due to the ballast weights 4 the apparatus starts to go to the bottom of the water basin being explored. On reaching a depth at which the hydrostatic pressure is higher than the pressure in the hydrostatic safety locks 14*a*, the hydrostatic safety locks become smaller in size and come out of the holes 14 (FIGS. 1, 2). Due to this the apparatus is released from the safety locks and becomes ready for operation.

When reaching the bottom of the water basin being explored the lower part of the apparatus suddenly stops but the float 1 acted upon by inertia continues to move down.

The rod 2 moves downwardly followed by the pin-type catches 15 which results in relasing the shackles 17 and fixing links 18. The internal sleeve 20 together with the striker 23 also moves with respect to the external sleeve 19 until the retaining balls 25 align with the annular recess 21 of the external sleeve 19. As a result, the striker 23 is released and under the action of the spring 27 moves to impart an impact to destroy the shell 6. As the pressure inside the shell 6 is some hundreds of times less than the surrounding hydrostatic pressure, a blast followed by a hydraulic impact occurs as a result of which a sample of the bedrock mating to the working member is chipped off and moved into the working member of the apparatus. The flexible links 28 previously rested against the shell 6 are contracted to pull the flexible flaps thus closing the shutter 8. At the same time the ballast weights 4 after being freed from the fixing links 18 turn the containers 3 about the axles 13 and fall out of them.

The apparatus attains positive buoyancy and emerges to the surface of the water basin to be taken aboard ship (FIG. 12). The casing 5 of the working member (FIG. 1) is detached over the flange connection 30 and the obtained sample is removed from the casing.

According to another embodiment of the invention the working member (FIG. 6) of the apparatus for taking bedrock samples from the bottom of deep-water basins is made in the form of a slit casing 5 having a flanged connection 30. The upper part of the working member casing 5 is made in the form of a taper thrower 31 to which the shell 6 is pressed through a ring shock absorber 32.

Mounted on the inner surface of the working member casing 5 is a ferrule 33 which forms together with the lower part of the casing 5 a pocket 34 and a packing ring 35 is secured on the lower edge of the working member casing 5.

Such design of the working member allows the area where a sample is taken to be isolated with the help of the packing ring on uneven bedrock of the ocean bottom. In addition, the taper thrower 31 directs a sample detached from the body of rock and getting into the interior of the working member casing 5 to the pocket 34.

The apparatuses for taking bedrock samples from the bottom of deep-water basins contrived like herein described operate as discussed above.

At the moment the bottom is reached the lower part of the apparatus suddenly stops, the interior of and the working member is isolated from the surrounding medium since the lower part of the casing 5 is tightly fit to the bedrock surface due to the packing ring 35.

Then the initiating device 7 operates in the way described above.

Destruction of the shell 6 causes a blast followed by a hydraulic impact detaching a sample from the bedrock mating to the working member and moving the sample into the casing 5 of the working member. Bedrock fragments coming into the interior of the casing 5 of the working member strike against the thrower 31 and while moving towards the periphery enter the pocket 34.

Then, the apparatus functions like the above described first embodiment of the invention. After the apparatus emerges and is taken aboard ship, the casing 5 of its working member is opened over the flange connection 30 and the sample is removed.

Alternatively, the working member of the apparatus (FIG. 7) may be made as a casing 5 detachable over the flange connection 30, a cover of the casing 5 being shaped as a hemispherical thrower 31. Ferrules 33 together with the inner surface of the casing 5 of the working member make up pockets 34; the upper part of the working member casing 5 is provided with check valves 36. The lower part of the working member casing 5 is also made split with a threaded connection 37.

The initiating device 7 (FIG. 9) is vertically mounted in the interior of the shell 6 on supports 38 and prevented from displacement with an adjusting screw 39. The striker 23 having the annular recess 24 accommodating the retaining balls 25 is arranged in a housing 40 provided with holes 41 to receive the retaining balls 25. An inertia bush 42 is movably mounted in the housing 40 and has a conical spring 43. The striker 23 has a spring 27.

Such a design of the initiating device enables effective destruction of the shell at the moment of contact with the bottom of the water basin.

This embodiment of the apparatus for taking bedrock samples from the bottom of deep-water basins operates in the following way.

Prior to dropping overboard, the apparatus is made ready for operation, for which purpose the ballast weights 4 are placed into the containers 3 (FIG. 7), fastened over perimeter with the fixing links 18 (FIG. 2) and the shackles 17 are inserted into the barrel 16. Then by displacing the rod 2 upwardly the pin-type catches 15 are introduced into the sleeve 19 thus fixing the shackles 17. The holes 14 in the movable sleeve 11 and the guide bush 10 are aligned and the hydrostatic safety locks 14*a* are inserted therein. After this, the initiating device 7 (FIGS. 7, 8) is prepared for operation. With this in view, by depressing the striker 23 the spring 27 is cocked and the annular recess 24 is aligned with the holes 41 of the housing 40 in which the retaining balls 25 are placed and fixed with the inertia bush 42. This done, the initiating device 7 is arranged in a vertical position inside the shell 6 detachable over the diameter with the help of the supports 38 and the adjusting screw 39; the shell 6 in turn is placed into the casing 5 (FIG. 7) of the working member through the open threaded connection 37. The shell 6 is fixed against displacements with an edge of the ferrule 33.

The apparatus thus prepared is dropped overboard (FIG. 12). Under gravity due to the ballast weights 4 the apparatus starts to sink. On reaching a depth at which the hydrostatic pressure exceeds the pressure in the hydrostatic safety locks 14*a*, they become smaller in size and come out of the holes. Now the apparatus is freed from the safety locks and ready for operation.

Upon reaching the ocean bottom the lower part of the apparatus (FIGS. 7, 8, 9) suddenly stops while the float 1 continues by inertia to move downwardly displacing the rod 2 along with the pin-type catches 15, thereby freeing the shackles 17 with the fixing links 18. At the same time the inertia bush 42 moves downwardly due to inertia along the housing 40, compresses the conical spring 43 and frees the balls 25, which in turn release the annular recess 24 of the striker 23 enabling the striker 23 under the action of the spring 27 to impart an impact against the shell 6 and to destroy it. As the pressure inside the shell 6 is some hundreds of times less than the surrounding hydrostatic pressure, a blast followed by a hydraulic impact occurs which detaches a sample of bedrock mating to the working member and the sample thus obtained is brought into the casing 5 of the working member of the apparatus. Just after the destruction of the shell 6 the pressure in the casing 5 of the working member drops sharply to entrain bedrock fragments which hit at the hemispherical thrower 31 wherefrom they are directed to the peripheral pockets 34. Water forced together with bedrock fragments into the working member casing 5 causes a sharp increase of the pressure in the working member casing 5 which results in opening of the check valves 36, the area of which is greater than that of a circle defined by the upper edge of the upper ferrule 33. This results in outburst of water through the check valves 36 from the working member casing 5, and since the area of the open check valves 36 is greater than the cross-sectional area of the circle defined by the upper edge of the upper ferrule 33, the speed of water outflow is such that the bedrock fragments settle down in the upper pocket 34.

At the same time, the ballast weights made free of the fixing links 18 turn the containers 3 about the axles 13 and fall out of them. The apparatus attains positive buoyancy and emerges to the water basin surface to be recovered aboard ship (FIG. 12) wherein the working member casing 5 (FIG. 7) is opened over the flange connection 30 and the sample is removed therefrom.

Still another embodiment of the apparatus of the invention is provided with the working member casing 5 (FIG. 10) having a joint accommodating expansion springs 44 and protected from inside with a seal 45 and covered from outside with enveloping clamps 46. The taper thrower 31 against which the shell 6 rests is made in the form of a taper striker 47 and is essentially a major part of the initiating device 7. The lower part of the shell 6 rests through the ring shock absorber 32 on the upper edge of the ferrule 33. The working member casing 5 is secured to the supporting frame 9 by a bolt 48, and has the flanged connection 30 in the middle part and the packing ring 35 in the lower part thereof.

Such an embodiment of the working member of the apparatus being very simple in design features high reliability and efficiency when taking bedrock samples.

This apparatus for taking bedrock samples from the bottom of deep-water basins operates similarly to those described above. The main distinction is that on reaching the water basin bottom the lower part of the apparatus casing 5 suddenly stops but the upper part with the enveloping clamps 46 continues to move downwardly by intertia thereby compressing the expansion springs 44. The taper thrower 31 imparts with its upper part, made in the form of the taper striker 47, a blow on the shell 6 thus breaking it. Further process of taking a sample and emerging of the apparatus goes on as described above.

Another alternate embodiment of the invention features a hemispherical thrower 31 (FIG. 11) rotatable on a bearing 49 about an axle which is esentially the initiating device 7. The thrower 31 is provided with through holes 50 and radial ribs 51, and is connected with a flywheel 52 which in turn is coupled through an overrunning clutch 53 with a hydraulic turbine 54 whose blades 55 are disposed over the generatrix of the hydraulic turbine 54. The flywheel 52 and hydraulic turbine 54 are covered with a protective ring 56. Mounted in the upper part of the working member casing 5 on brackets 57 are vertically-oriented stabilizing fins 58 intended to compensate for reaction torque due to rotation of the hydraulic turbine 54, flywheel 52 and hemispherical thrower 31. There is an annular clearance 59 between the internal wall of the upper part of the working member casing 5 and the external part of the hemispherical thrower 31.

Owing to such a design of the apparatus working member it becomes possible to facilitate catching and holding a bedrock sample by providing stable rotation of the water contained in the apparatus working member.

The herein disclosed apparatus operates as follows.

When the apparatus prepared for operation in the way described above sinks by the ballast weights 4 (FIGS. 1, 9, 12), the incoming water flow causes by means of the blades 55 rotation of the hydraulic turbine 54. The torque thus obtained is transmitted through the overrunning clutch 33 to the flywheel 52 and hemispherical thrower 31 which results in creating a stable vertical whirl of water inside the casing 5 of the working member. The stabilizing fins 58 compensate for arising torque and prevent rotation of the apparatus as a whole.

When the apparatus reaches the ocean bed and strikes against the bedrock, the packing ring 35 (FIG. 11) is crumpled due to which the interior of th working member casing 5 is sealed. After the initiating device 7 operates to break the shell 6, the bedrock in the area of contact with the casing 5 of the working member of the apparatus is destroyed. Fragments of the bedrock entrained by water flow to the interior of the casing 5 of the working member of the apparatus. To decrease the effect of the hydraulic impact on the hemispherical thrower 31, a portion of the water and of the fragments of the bedrock enter through the holes 50 to the cavity above the hemispherical thrower 31.

At this time the hemispherical thrower 31 in conjunction with the flywheel 52 continues to rotate due to operation of the overrunning clutch 53 which kinematically desingages the flywheel 52 from the hydraulic turbine 54 with the blades 55. After the apparatus strikes against the bottom of the water basin being explored, the hydraulic turbine 54 with blades 55 is braked by the friction forces arising due to the blades 55 moving in stationary water. The bedrock fragments brought to the hemispherical thrower 31 are displaced under the action of centrifugal forces to the periphery of the interior of the casing 5 of the apparatus working member and come into the pocket 34. The part of the sample entrained through the holes 50 to the upper surface of the hemispherical thrower 31 also comes in the pocket 34 passing through the annular clearance 59. Then the device for dropping ballast weights operates as described above and the apparatus for taking bedrock samples from the bottom of deep-water basins attains positive buoyancy and emerges to the surface of the water basin (FIG. 12) to be taken aboard ship, whereupon the casing 5 of the working member of the apparatus is opened over the flange connection 30 and the sample is removed.

Industrial Applicability

The invention can be used to advantage to carry out geological, hydrographic and oceanological researches for non-ferrous metallurgy.

We claim:

1. An apparatus for taking bedrock samples from the bottom of deep-water basins, having a float with a rod and a supporting frame, containers with ballast weights, a device for dropping ballast weights, and a working member, wherein the improvement comprises the working member having a split casing with an open bottom and accommodating a shell; an initiating device destroying said shell at the moment the working member comes in contact with the bottom of a water basis; and a device for catching and holding a sample.

2. An apparatus according to claim 1, wherein the initiating device is installed in the upper part of the casing of the working member and is operatively associated with the device for dropping ballast weights.

3. An apparatus according to claim 2, wherein the initiating device comprises external and internal sleeves arranged one inside the other, said external sleeve being provided with an annular recess and the internal sleeve being mounted on the lower part of the rod of the float for movement with respect to the external sleeve; and a striker having an annular recess and a spring disposed in the internal sleeve, retaining balls disposed in holes of the internal sleeve, and a lock washer mounted under the external and internal sleeves.

4. An apparatus according to claim 2, wherein an upper part of the casing of the working member is split and is movable, and the initiating device is installed on an internal surface of said casing.

5. An apparatus according to claim 1, wherein the initiating device is installed inside the shell and is provided with an operatively independent release mechanism including a springloaded inertia bush.

6. An apparatus according to claim 1, wherein a lower part of the casing of the working member is provided with a packing ring.

7. An apparatus according to claim 1, wherein an upper part of the casing of the working member is split and the walls accommodate check valves.

8. An apparatus according to claim 1, wherein the device for catching and holding a sample includes a curtain shutter incorporating flexible flaps, each flap being secured at a first end to lower edges of the casing of the working member and secured at a second end to flexible links of the curtain shutter.

9. An apparatus according to claim 1, wherein the device for catching and holding a sample includes at least one row of pockets disposed axially relative to the working member.

10. An apparatus according to claim 1, wherein an upper part of the casing of the working member includes a thrower having a taper or hemispherical shape.

11. An apparatus according to claim 10, wherein the thrower is rotatable about an axis of the initiating device, is mounted with a clearance over a peripheral portion of the working member and is provided with through holes and radial ribs.

12. An apparatus according to either of claims 10 or 11, wherein the thrower is made integral with a flywheel and operatively associated through an overrunning clutch with a hydraulic turbine mounted on an external part of the casing of the working member.

13. An apparatus according to claim 1, wherein the device for dropping ballast weights is disposed in a middle part of the supporting frame coinciding with the rod of the float, and includes pin-type catches cooperating with flexible links fixing the ballast weights.

14. An apparatus according to claim 13, wherein an upper part of the supporting frame includes a guide bush with a movable sleeve having holes closed with hydrostatic safety locks.

* * * * *